US006045285A

United States Patent [19]

Friedman

[11] Patent Number: 6,045,285

[45] Date of Patent: Apr. 4, 2000

[54] SPIRAL BINDER WITH LOCKING ELEMENT

[76] Inventor: Michael N. Friedman, Seven Harbor Ct., Centerport, N.Y. 11721

[21] Appl. No.: 09/196,068

[22] Filed: Nov. 19, 1998

[51] Int. Cl.[7] ..... B42F 3/02

[52] U.S. Cl. ..... 402/19; 29/521; 29/525.01; 29/766; 281/21.1; 402/26; 402/79; 402/80 R; 402/501; 412/39; 412/40

[58] Field of Search ..... 402/19, 26, 75, 402/57, 501, 79, 500, 802, 20, 80 P, 80 R; 281/21.1, 27.3; 412/39, 40; 29/525.01, 505, 521, 766

[56] References Cited

U.S. PATENT DOCUMENTS

| | | | |
|---|---|---|---|
| 2,099,881 | 11/1937 | Emmer | 402/20 |
| 2,188,680 | 1/1940 | Farkas | 402/26 |
| 2,249,064 | 7/1941 | Tauber | 402/20 |
| 2,754,826 | 7/1956 | Berberich | 412/40 |
| 3,373,748 | 3/1968 | MacCormack | 402/70 |
| 5,417,508 | 5/1995 | Friedman | 402/19 |

*Primary Examiner*—Andrea L. Pitts
*Assistant Examiner*—Monica Smith
*Attorney, Agent, or Firm*—Bauer & Schaffer, LLP

[57] ABSTRACT

A reusable refillable binder for use with papers having marginal perforations. The binder including a spiral coil having tapered ends, each of the ends of the coil having an area width for receipt of a removable locking element. A removable locking element for securement to binding element about the area of reduced width to prevent the unintentional unbinding of the binder when secured to the coil and to allow the user to unbind the binder when the locking element is removed.

13 Claims, 2 Drawing Sheets

Fig. 1
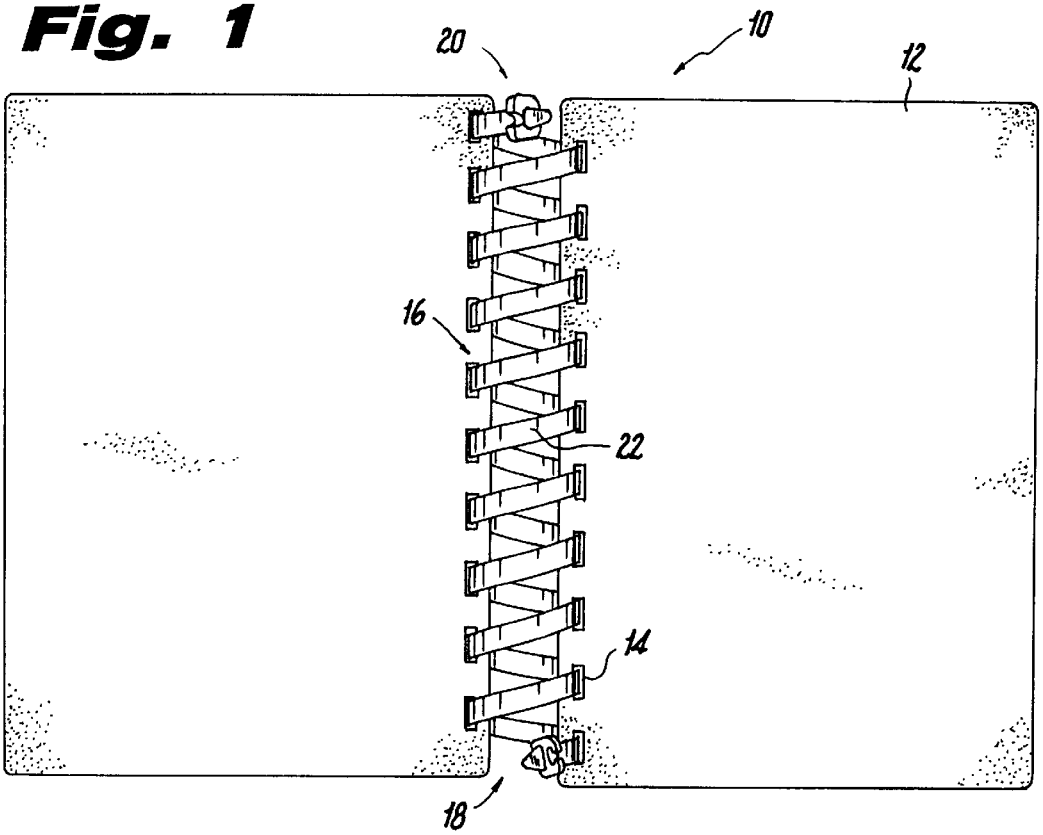
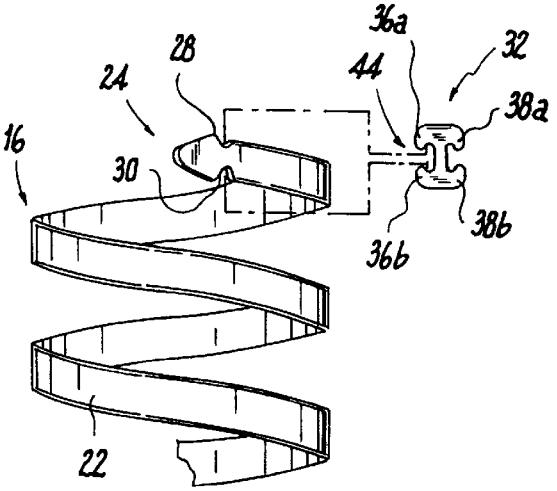
Fig. 2
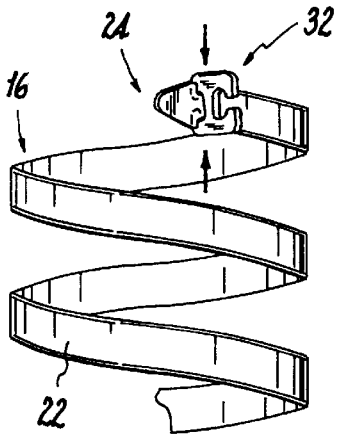
Fig. 3

SPIRAL BINDER WITH LOCKING ELEMENT

BACKGROUND OF THE INVENTION

The present invention relates to a spiral binder for papers and the like having marginal perforations and, more particularly, to a improved spiral binder having a spiral binding element.

In the past spiral ring binders have been constructed such that a narrow gauge plastic or metallic wire that has been helically or spirally coiled is passed through perforations in the margins of the papers, such that the papers are held in bound condition. The wires used in these binders are usually crimped or bent at their ends to prevent the papers from unbinding. The crimp or bend in the terminal end of the wire also acts to prevent the coils from rotating, thereby preventing the coils from gradually creeping outward at either end of the binder.

The spiral binders described above have come to be considered permanent for all practical purposes as they can not be refilled or reused without great difficulty and inconvenience to the user.

To overcome the shortcomings inherent in the devices described above, my prior patent, U.S. Pat. No. 5,417,508, disclosed a spiral-type binder having opposite coiled ends with a plurality of spiral coils interposed therebetween and a removable locking element coupled at both ends of the coil. This construction permitted the binder when in the locked state to securely retain the bound pages while at the same time permitting the removal of the locking element to add or remove pages to and from the binder.

The locking element as disclosed in my prior patent included a first end adapted to at least partially encircle one ring of the coil and a second end adapted to be inserted through a hole provided in the outermost ring of the coil.

Although the binder disclosed in the '508 patent is effective, over time it became apparent that the binder disclosed therein could be improved.

First, the binder disclosed in the '508 patent is somewhat costly to manufacture in that a molding process was used to produce the spiral binding element. As a result, a rather intricate and costly mold was required. Further, if a different length or diameter spiral was desired a new mold was required, resulting in additional costs.

Second, if the alignment of the molds used in the molding procedure is not perfect the resultant parts may have ridges or steps that may hamper the binding or unbinding of the papers held by the binder.

It is therefore, the object of the present invention to provide a spiral binder that overcomes the defects and disadvantages of the prior art.

It is another object of the present invention to provide a improved reusable spiral binder that is simple in construction, easy to operate and durable.

It is a further object to provide an improved locking device that does not compromise the structural integrity of the spiral element.

It is another object to provide a spiral binder that inexpensive, versatile and easy to manufacture.

These objects, together with other objects and advantages, will be apparent from the following disclosure of the present invention.

SUMMARY OF THE INVENTION

The present invention overcomes the disadvantages found in the prior art by providing a spiral binder having a spiral binding element with a plurality of coils which can be easily and quickly threaded through the perforations of the sheets and covers of a bound book or the like. The outermost coil at each end of the binding element has an area of reduce width adapted to receive a removable locking element.

The binder according to the present invention is provided with a removable locking element coupled to each end of the binder to prevent the spiral binding element from accidently traveling or unbinding. The locking elements may be removed to allow the unbinding of the sheets by the user to permit the addition or removal of sheets to or from the binder as desired. The locking element is adapted to partially encircle the outermost coil of the binding element about the area of reduced width.

The present invention generally comprises an improved reusable spiral binder for papers and the like having marginal perforation. The binder includes a spiral binding element having a plurality of spaced coils along the length thereof, the outermost coil at each end of the binding element having an area of reduced width. A removable locking element is coupled to each end of the binding element such that it partially encircles the area of reduced width to prevent the rotation of the binding element and the unbinding of the papers from the binder.

BRIEF DESCRIPTION OF THE DRAWINGS

In the drawings:

FIG. 1 is a plan view of a book bound by the spiral binder according to the present invention;

FIG. 2 is a view of the binder shown in FIG. 1, illustrating a removable locking element in accordance with the present invention removed from the spiral binding element;

FIG. 3 is a view of the binder shown in FIG. 1 with the locking element coupled to the spiral binding element;

DETAILED DESCRIPTION OF THE INVENTION

Figure 4:
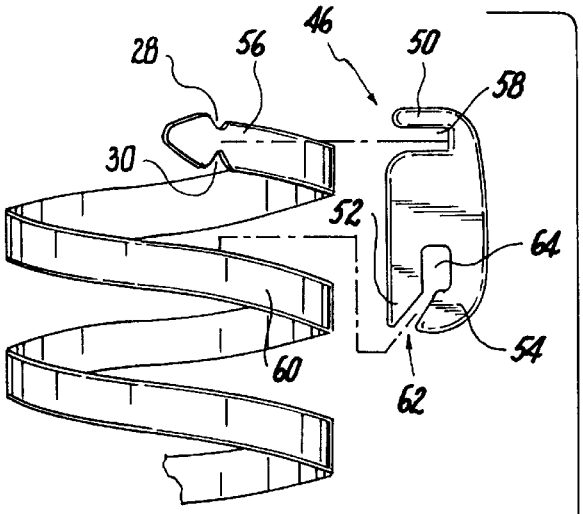
FIG. 4 is a view of a removable locking element according to a second embodiment of the invention removed from the spiral binding element.
Figure 5:
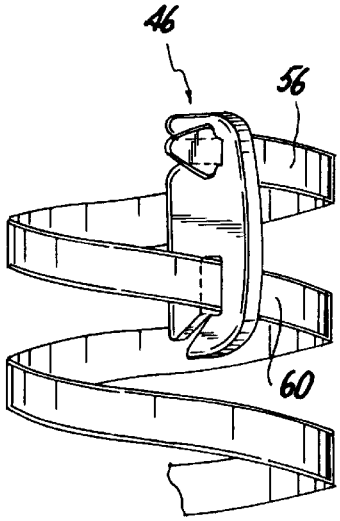
FIG. 5 is a view of the binder shown in FIG. 4 with the locking element coupled to the spiral binding element.

As seen in FIG. 1, the present invention relates to a refillable spiral binder, generally depicted by the numeral 10. The binder 10, as illustrated in FIG. 1, binds a plurality of sheets 12. Each sheet 12 has a plurality of equally spaced marginal perforations 14 along the peripheral edge of the sheet as shown.

The sheets of the binder are held in a bound state by a spiral or helical binding element 16 having a first and second end, 18 and 20 respectively. Interposed between the ends 18 and 20 of the binding element are a plurality of spiral coils 22. The coils are arranged such that their position corresponds to the perforations 14 so that the coils may be threaded through the perforations to thereby bind the sheets.

The ends 18 and 20 of the binding element are provided with a tapered leading edge 24 as best seen in FIGS. 2 and 3. The tapered leading edge 24 allows the spiral binding element to be quickly and efficiently inserted through the perforations 14. The terminal ends of the binding element are also provided with opposed notches or detents 28 and 30. The notches or detents 28 and 30 act to define an area of reduced width proximate the terminal end of the binding element. The area of reduced width, as described hereinafter, is inserted and held within the removable locking element 32.

Preferably, the spiral coil 16 is manufactured by extruding lengths of material having a constant cross section, e.g. width. These sections of material are then heat formed to conform to the desired helical shape. Once formed, the tapered ends and the notches 28 and 30 may be formed by using a single die cutting operation, thereby keeping manufacturing costs to a minimum. The above described procedure allows a variety of binders, having a variety of diameters to be produced inexpensively with minimal re-tooling costs. Of course, a molding procedure may alternatively be used, if desired, however the initial costs to generate molds will be higher and seperate molds will be required for each size binder to be produced.

The spiral coil 16 is preferable constructed from a suitable plastic, however it will be apparent to those skilled in the art that other suitable materials may also be used to form the coil 16 such as a pliable metal or the like.

As seen in FIG. 2, the spiral coil 16 is provided at each of its ends with a removable locking element 32 which prevents the rotation of the sheets 12, as well as prevents the travel of the coil 16 and thus the unbinding of the sheets 12 from the binder 10.

The locking element 32 has a body with a first and second pair of curved hooks, 36*a* and 36*b*, and, 38*a* and 38*b*, respectively. Each hook comprising a hook pair, i.e. 36*a* and 36*b*, is angled in toward the other as shown forming a claw adapted to engage notches 28 and 30 of the outermost ring element. As shown, each hook pair is formed on opposite sides of the locking element body, providing a locking element that is symmetrical in both the horizontal and vertical planes. The symmetrical nature of the hooks allows either pair of hooks to be engaged to the spiral binding element. By depressing either pair of hooks, 36*a* and 36*b* or 38*a* and 38*b*, between the thumb and index finger the user can increase the space 44 between the opposed pair of hooks allowing the insertion and removal of the binding element 16. This permits the user to easily attach the locking element to the binding element 16 using either side of the element. As shown in FIG. 3, when in the locked position, the locking element engages the binding element by partially surrounding the area of reduced width.

In use, for example, the locking element 32 is manually placed at each end 18 and 22 of the spiral coil by depressing the hooks 38*a* and 38*b* so that the space 44 between the opposed hooks 36*a* and 36*b* is increased allowing the reception of the binding element 16. The first pair of hooks are then released so that the hooks 36*a* and 36*b* return to their original position and engage the notches 28 and 30. Upon release of the hooks 38*a* and 38*b* the claw formed by the members 36*a* and 36*b* grasp the spiral binding element 16 as shown in FIG. 3. Once in the locked position the locking element 32 prevents the rotation of the coils and the unbinding of the sheets.

The removable locking element 32 may be removed by depressing the hooks 38*a* and 38*b*, thereby increasing the space 44 between the hooks 36*a* and 36*b*, allowing the removal of the locking element from the binding element. The binding element can then be unthreaded from the sheets to permit the removal or addition of pages as desired.

The locking element 32 should be constructed from a material having a memory such that when the force placed on the element by the user is removed the element returns to its original shape. Further, the locking element should be have a dimension such that when it is in its relaxed state it fits snugly around the area of reduced width as defined by the detents 28 and 30.

An alternative embodiment 46 of the locking element 32 is shown in FIG. 4. As seen the locking element 46 has a body with a first end having a hook 50 and a second end having a pair of spaced legs 52 and 54. The hook 50 is configured such that it receives the outermost coil 56 of the spiral element 16 within a channel 58 formed between the hook 50 and the locking element body. The second end is adapted to receive spiral coil adjacent the outermost coil, i.e. coil 60. As shown the coil 60 is inserted through a opening 62 between two legs 52 and 54, and received within in a chamber 64.

In use, the locking element 46 is secured to the spiral coil 16 at ends 18 and 22 by inserting 58 through the opening 62 so that the coil is received within the chamber 64. The outermost coil 56 is then inserted in the channel 58 formed between hook 50 and the body of the locking element. The coil 56 is positioned so that the area of reduced width formed by the detents 28 and 30 fits within the channel 58. In this manner, the locking element 46 is held securely in place thereby preventing the rotation or travel of the coils and thus preventing the unwanted unbinding of the sheets 12. The user may remove the locking element 34 by simple reversing these steps thereby allowing the unbinding of the book to add or remove pages as desired.

Figure 6:
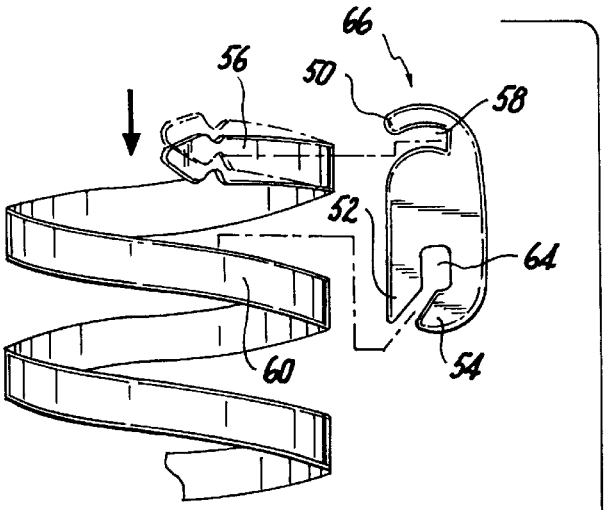
FIG. 6 is a view of the binder shown in FIG. 4 with an alternate embodiment of the locking element shown therein as removed from the spiral binding element.
Figure 7:
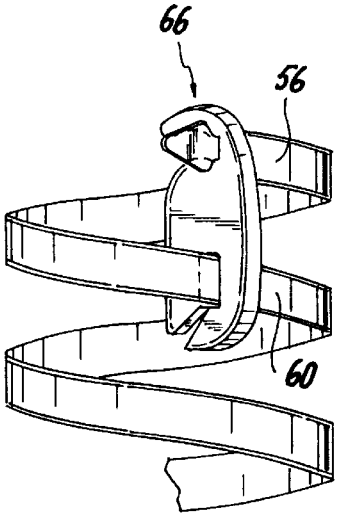
FIG. 7 is view of the binder shown in FIG. 6 with the locking element coupled to the spiral binding element.

A variation of locking element 46, generally depicted by the numeral 66, is shown in FIG. 6. As seen, in this version the hook 50 is curved or angled back towards the body of the locking element. In this way, the opening to the channel 58 is orientated so that it faces the body 48 of the locking element. To insert the outermost coil 56 into the channel 58 the coil must be partially twisted or rotated, as shown in FIG. 6, to fit within the opening to the channel. After the coil 56 is rotated to fit within the channel it is released and returns to its relaxed state and fits securely within the channel 58. As the coil 56 must be slightly deformed in order to insert or remove the same to or from the channel 58 the coil will not inadvertently fall out or dislodge from the locking element, thereby providing additional security.

The locking elements as described above are all molded of high strength, such as a suitable polymeric material. However, it is understood by those skilled in the art that other materials and forms of construction are suitable.

From the above description, it will be seen that the binder according to the present invention is refillable and reusable binder by providing a spiral coil having tapered ends provided with notches or indents adapted to be inserted within a removable locking element. By removing the locking element the spiral coil may be quickly and easily unthreaded through perforations in the sheets and covers for the purpose of adding or removing sheets. The locking element is configured so that when it is secured to the coil ends it is held securely in place thereby preventing the unintentional unbinding of the sheets, while at the same time allowing easy removal of the element to allow unbinding of the sheets by the user. Further, the coil ends have been designed so that they may be machined using a single manufacturing process, keeping manufacturing costs to a minimum.

The foregoing description has been presented for purposes of illustration and description. It is not intended to be exhaustive or to limit the invention to the precise form disclosed. Obvious modifications are possible in light of the above teaching without departing from the spirit of the invention.

What is claimed is:

1. A binder for use with papers having perforations along the edge thereof comprising: a spiral binding element having coiled ends, at least one of said coiled ends having an area of reduced width relative to a remainder of said spiral binding element, and a removable locking element coupled to said spiral binding element so that it partially surrounds said area of reduced width, whereby said locking element is selectively secured and removed from the spiral element to alternate from a secured locked state to an open state to permit the threading and unthreading of said spiral binding element.

2. The binder according to claim 1, wherein said area of reduced width is defined by a pair of opposed detents.

3. The binder according to claim 2, said removable locking element having a first pair of opposed hooks defining a claw for engaging said detents.

4. The binder according to claim 3, said removable locking element having a second pair of opposed hooks.

5. The binder according to claim 4, wherein said spiral binding element comprises a strip of coiled material.

6. The binder according to claim 5, wherein said coiled ends are provided with tapered leading edges.

7. A binder for use with papers having perforations along the edge thereof comprising: a spiral binding element having coiled ends, at least one of said coiled ends having an area of reduced width relative to a remainder of said spiral binding element, and a removable locking element coupled to said spiral binding element, said locking element comprising a body having first and second ends, said first end partially encircling said coiled end so that it partially surrounds said area of reduced width and said second end encircling a spiral coil adjacent said coiled end, whereby said locking element may be selectively secured and removed from the spiral element to alternate from a secured locked state to an open state to permit the threading and unthreading of said spiral binding element.

8. The binder according to claim 7, wherein said area of reduced width is defined by a pair of opposed detents.

9. The binder according to claim 8, said first end having a hook spaced and substantially parallel to said body of the locking thereby defining a channel between said hook and said body for receiving and holding said coiled end.

10. The binder according to claim 9, said second end having a pair of spaced legs defining an opening therebetween, said opening communicating with a chamber for holding said coil adjacent said coiled end.

11. The binder according to claim 9, wherein said hook is angled toward said body of the locking element.

12. The binder according to claim 11, wherein said spiral binding element comprises a flat strip of coiled material.

13. The binder according to claim 12, wherein said coiled ends are provided with tapered leading edges.

* * * * *